US011585304B2

(12) United States Patent
Nishizawa

(10) Patent No.: US 11,585,304 B2
(45) Date of Patent: Feb. 21, 2023

(54) RAIL FOR HIGH-PRESSURE DIRECT INJECTION

(71) Applicant: USUI CO., LTD., Shizuoka (JP)

(72) Inventor: Hiroyuki Nishizawa, Shizuoka (JP)

(73) Assignee: USUI CO., LTD., Shizuoka (JP)

( * ) Notice: Subject to any disclaimer, the term of this patent is extended or adjusted under 35 U.S.C. 154(b) by 0 days.

(21) Appl. No.: 16/645,791

(22) PCT Filed: Jul. 4, 2018

(86) PCT No.: PCT/JP2018/025304
§ 371 (c)(1),
(2) Date: Mar. 10, 2020

(87) PCT Pub. No.: WO2019/058707
PCT Pub. Date: Mar. 28, 2019

(65) Prior Publication Data

US 2020/0271079 A1 Aug. 27, 2020

(30) Foreign Application Priority Data

Sep. 19, 2017 (JP) ..... JP2017-178657

(51) Int. Cl.
*F02M 55/00* (2006.01)
*F02M 55/02* (2006.01)

(52) U.S. Cl.
CPC ..... *F02M 55/005* (2013.01); *F02M 55/025* (2013.01); *F02M 2200/80* (2013.01); *F02M 2200/851* (2013.01); *F02M 2200/856* (2013.01)

(58) Field of Classification Search
CPC .... F02M 55/00; F02M 55/004; F02M 55/005; F02M 55/02; F02M 55/025; F02M 2200/856; F02M 2200/80
(Continued)

(56) References Cited

U.S. PATENT DOCUMENTS

2006/0169253 A1* 8/2006 Usui ..... F02M 55/025 123/468
2009/0223486 A1 9/2009 Weizenauer et al.
(Continued)

FOREIGN PATENT DOCUMENTS

JP 09280459 A * 10/1997 ..... F02M 55/025
JP 2004-27916 A 1/2004
(Continued)

OTHER PUBLICATIONS

International Search Report for PCT/JP2018/025304 dated Oct. 9, 2018.

*Primary Examiner* — Phutthiwat Wongwian
*Assistant Examiner* — Arnold Castro
(74) *Attorney, Agent, or Firm* — Yokoi & Co., U.S.A.; Toshiyuki Yokoi

(57) ABSTRACT

The flexibility of the attachment angle and attachment interval of the member (e.g., injector) attached to the joint member is increased to improve the flexibility of layout even in the case of the forged rail for high-pressure direct injection. In addition, the manufacturing cost can be reduced while keeping high strength of the joint portion. A rail body 1 manufactured by forging, the rail body 1 having a through hole 4 opened on a wall surface 3 for communicating a fuel passage 2 extending in an axial direction with an outside; and a tubular joint member 6 manufactured separately from the rail 1 body and fixed to the rail body 1 at a position of the through hole 4 for allowing a fuel to flow from the fuel passage 2 through the through hole 4 are provided.

8 Claims, 5 Drawing Sheets

(58) Field of Classification Search
USPC ..... 123/456, 468–470; 285/133.11, 133.4
See application file for complete search history.

(56) References Cited

U.S. PATENT DOCUMENTS

| | | | | |
|---|---|---|---|---|
| 2013/0047961 | A1* | 2/2013 | Stichlmeir | F02M 55/004 123/446 |
| 2017/0226978 | A1* | 8/2017 | Soma | F02M 55/004 |
| 2017/0260945 | A1* | 9/2017 | Soma | F02M 61/168 |
| 2017/0260946 | A1* | 9/2017 | Suzuki | F02M 55/025 |
| 2017/0342950 | A1* | 11/2017 | Carey | F02M 63/0275 |

FOREIGN PATENT DOCUMENTS

| | | | | |
|---|---|---|---|---|
| JP | 2006-233964 | A | 9/2006 | |
| JP | 2009-524761 | A | 7/2009 | |
| JP | 2010-216431 | A | 9/2010 | |
| JP | 2010216431 | A * | 9/2010 | |
| WO | 2016/042897 | A | 3/2016 | |
| WO | WO-2016076194 | A1 * | 5/2016 | F02M 37/0017 |

* cited by examiner

RAIL FOR HIGH-PRESSURE DIRECT INJECTION

TECHNICAL FIELD

The present invention relates to a rail of gasoline direct injection capable of bearing an increment of pressure. The rail is manufactured by forging and used for the direct injection at a high fuel pressure exceeding 50 MPa.

BACKGROUND ART

The fuel pressure of the conventionally and generally known gasoline direct injection system is 20 MPa or less. In general, a rail body having a fuel passage inside is used by connecting an injector holder, a mounting boss and the like with the rail body by brazing. When the fuel pressure is within the above described range, sufficient pressure resistant strength can be obtained by increasing the thickness of the rail body. Thus, an injector and an injector holder can be connected with each other sufficiently by the sealing using an O-ring. Accordingly, it is not particularly necessary to use a high strength material.

On the other hand, in the fuel direct injection system using higher fuel pressure, it is general to manufacture the rail body itself by forging and cutting for ensuring high pressure resistance. In the high-pressure system, different from the above described case of using relatively low pressure (i.e., 20 MPa), it is difficult to connect the injector with the injector holder only by the O-ring since they receive the influence of high pressure. As an example of the above described rail for high-pressure direct injection, it is conventionally known that a joint portion of the injector holder or the like is integrally manufactured with the rail body by forging or other methods as shown in Patent Document 1.

Patent Document 1: WO2016/042897

DISCLOSURE OF THE INVENTION

Problems to be Solved by the Invention

However, in the fuel rail shown in Patent Document 1, it is necessary to form an entire shape in a planar shape for facilitating the forging. Thus, there is a problem that a forming direction of the joint portion is limited to a predetermined direction and flexibility is deteriorated. Therefore, also for the injector and other portions connected with the joint portion formed in the predetermined direction as described above, it is difficult to adjust the angle mounted on the rail body to a desired angle. Thus, flexibility of layout is deteriorated.

In case of the forging, since a bracket is also integrally manufactured with the rail body, flexibility of an arrangement angle between the bracket and the joint portion is also deteriorated. Furthermore, when the rail body and the joint portion are integrally manufactured by the forging, the joint portion is formed by moving the material from a base material having a straight shape. Thus, it is difficult to shorten the interval between the joint portions since the material to be moved becomes insufficient when the interval between the joint portions is narrow. Accordingly, in the conventional rail shown in Patent Document 1, it is difficult to improve the flexibility of layout.

Although the high strength material can be used for ensuring the pressure resistance and strength of the joint portion sufficiently, the bracket and the joint member are integrally manufactured with the rail body in case of the forging. Thus, the high strength material should be used for the entire the rail and the cost becomes higher.

The present invention is made for solving the above described problems. The present invention aims for improving the flexibility of layout by increasing the flexibility of the attachment angle and attachment interval of the member (e.g., injector) attached to the joint member even in the case of the forged rail for high-pressure direct injection. In addition, the manufacturing cost can be reduced while keeping high strength of the joint portion.

Means for Solving the Problem

The present invention solves the above described problems and includes: a rail body manufactured by forging, the rail body having a through hole opened on a wall surface of the rail body for communicating a fuel passage extending in an axial direction of the rail body with an outside; and a tubular joint member manufactured separately from the rail body and fixed to the rail body at a position of the through hole for allowing a fuel to flow from the fuel passage through the through hole.

As described above, since the joint member is manufactured separately from the rail body which is manufactured by forging, flexibility of the attachment interval and attachment angle of the joint member attached to the rail body is increased. Thus, flexibility of layout can be improved. In addition, the strength of the joint portion can be kept high by using expensive high strength material only for the joint member while using the material having normal strength for the rail body. Thus, the manufacturing cost can be kept low since it is not necessary to use the expensive high strength material for the entire rail.

In addition, when thread cutting is performed on the forged rail body with which the joint portion is integrally formed, a large cutting machine is required. However, since the joint member is manufactured separately, the large cutting machine is not required for processing the joint member. Thus, the processing work can be facilitated.

In addition, another tubular joint member manufactured separately from the rail body can be arranged and fixed on one end of the rail body for allowing the fuel to flow from the fuel passage through the one end of the rail body.

In addition, a mechanical strength of the joint member can be higher than the mechanical strength of a member jointed to the joint member.

Effects of the Invention

As explained above, in the present invention, since the joint member is manufactured separately from the rail body which is manufactured by forging, flexibility of the attachment interval and attachment angle of the joint member attached to the rail body is increased. Thus, flexibility of layout is improved. In addition, the strength of the joint portion can be kept high by using expensive high strength material only for the joint member without requiring to use expensive high strength material for the entire rail. Thus, the cost can be kept low.

In addition, in the conventional forged rail in which the joint portion is integrally manufactured with the rail body, a large cutting machine is required when thread cutting or the like is performed on the joint portion. However, when the joint member is manufactured separately as shown in the present invention, the large cutting machine is not required for processing the joint member. Thus, the processing work can be facilitated.

MODES FOR CARRYING OUT THE INVENTION

First Embodiment

Figure 1:
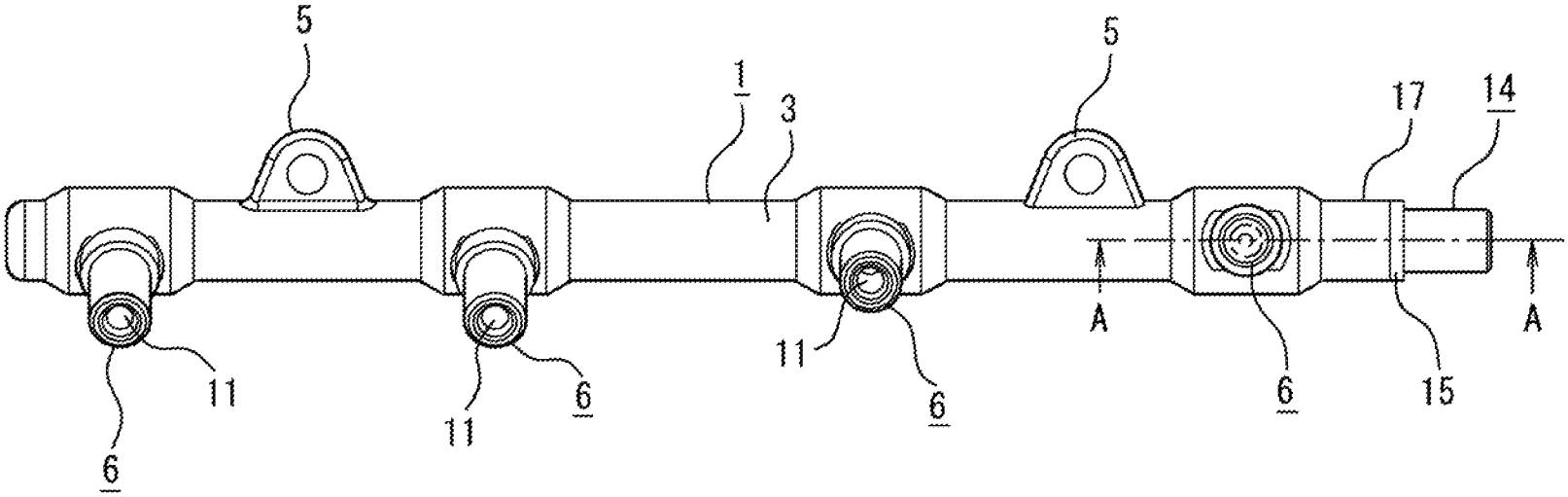
FIG. 1 is a perspective view showing the first embodiment of the present invention.

The first embodiment of the present invention will be explained below with reference to FIGS. 1 to 4. First, (1) shown in FIGS. 1 and 3 is a rail body manufactured by forging. As described above, when the rail body (1) is manufactured by forging, the pressure resistance of the rail body (1) itself can be increased. Thus, the rail body (1) can be used for the fuel direct injection system using high fuel pressure.

Figure 2:
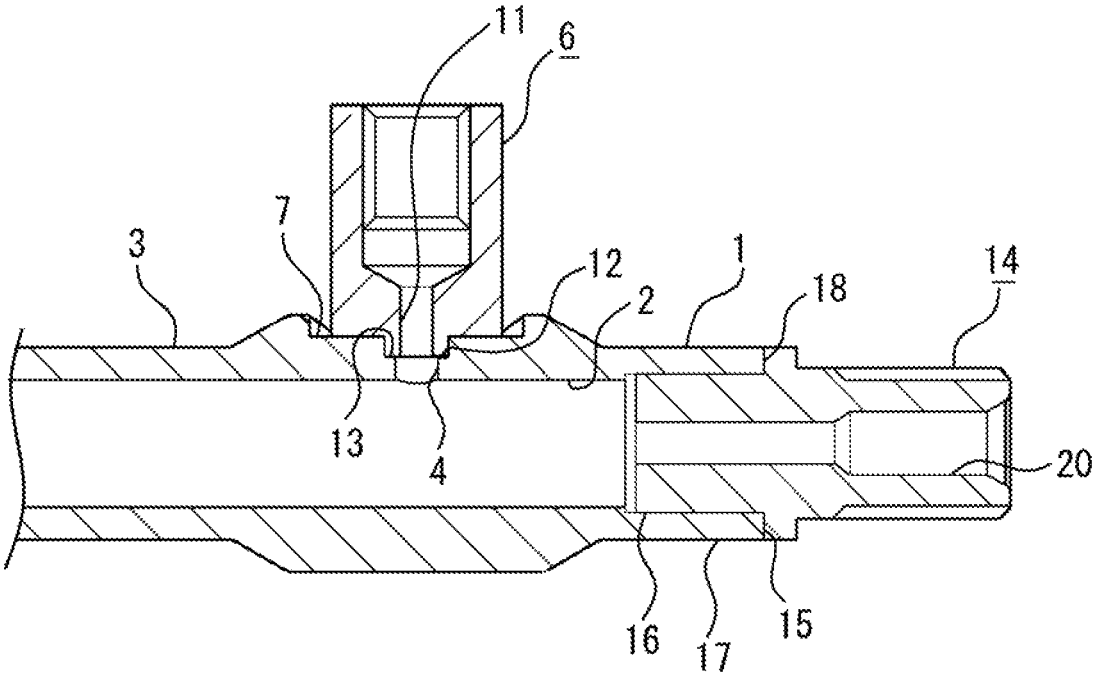
FIG. 2 is an enlarged cross-sectional view taken along the line A-A of FIG. 1.
Figure 3:
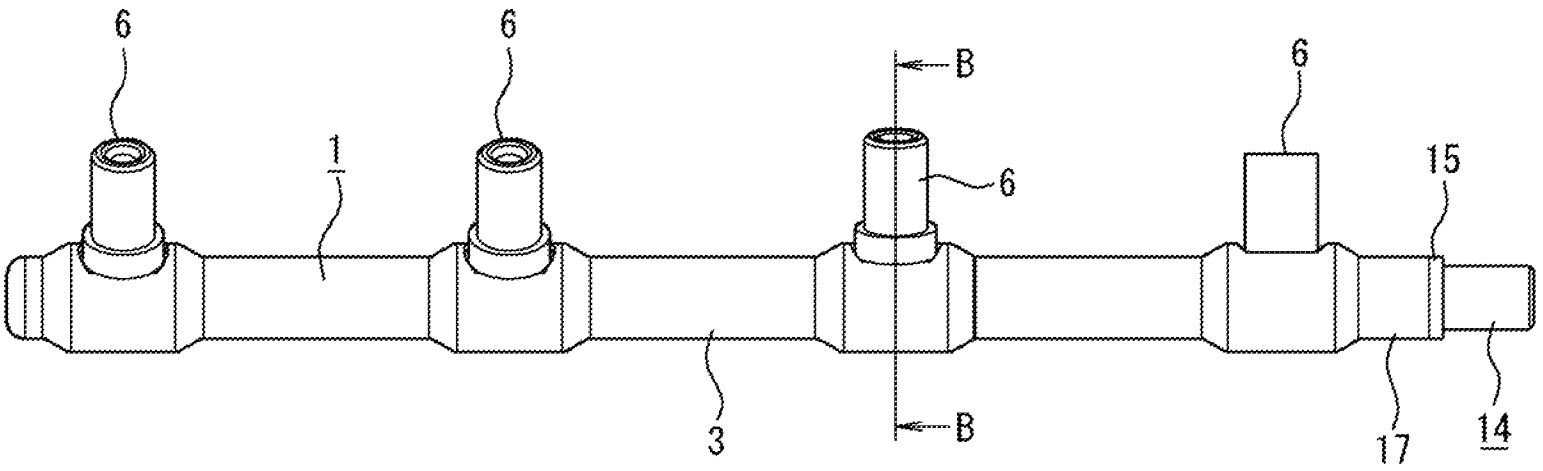
FIG. 3 is a perspective view from a different direction in the first embodiment.

In addition, as shown in FIG. 2, a fuel passage (2) is provided inside the rail body (1) along the axial direction of the rail body (1). Through holes (4) are formed through (opened on) a wall surface (3) of the rail body (1) at a plurality of positions. As described above, since the through holes (4) are formed through the wall surface (3), an outside of the rail body (1) and the fuel passage (2) are communicated with each other through the through holes (4). In addition, as shown in FIG. 1, fixing brackets (5) are provided on the rail body (1) at a plurality of positions in parallel in the axial direction.

In addition, as shown in FIG. 2, connecting recesses (7) are formed (recessed) on an outer periphery of the through holes (4) which are formed as described above. The connecting recesses (7) have an annular shape having a larger diameter than the outer diameter of a joint member (6) which will be explained later. In addition, an engaging recess (13) having a circular plane shape is provided on a peripheral edge of the through hole (4) located at the center of the connecting recess (7).

In the connecting recess (7), the joint member (6) manufactured separately from the rail body (1) is arranged and fixed to connect (join) the members such as an injector with the joint member (6). Note that a mechanical strength of the joint member (6) is higher than the mechanical strength of the member jointed to the joint member (6).

Figure 4:
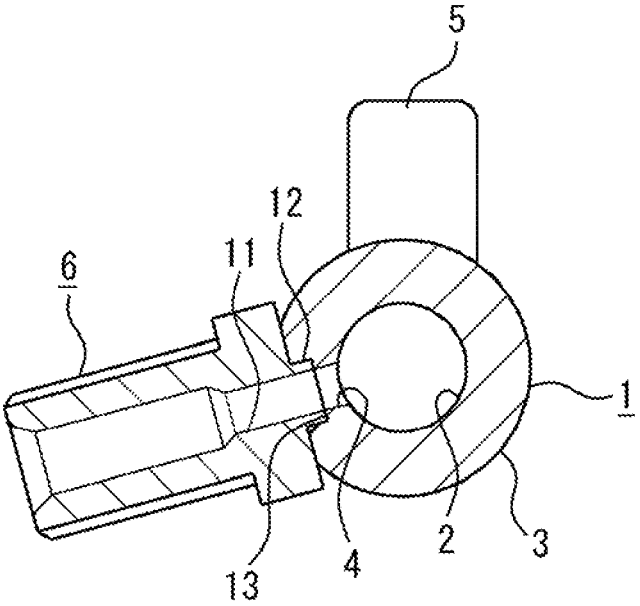
FIG. 4 is an enlarged cross-sectional view taken along the line B-B of FIG. 3.

In addition, the joint member (6) has a cylindrical (tubular) shape and the inside of the joint member (6) functions as a communication passage (11) of the fuel. The diameter of the joint member (6) is reduced at a base end portion (12). The base end portion (12) is inserted and arranged in the engaging recess (13) of the rail body (1) and fixed by brazing. Thus, the rail body (1) and the joint member (6) are connected and fixed with each other. In addition, when the joint member (6) is arranged and fixed on the rail body (1) as described above, the through holes (4) of the rail body (1) and the communication passage (11) of the joint member (6) are communicated with each other as shown in FIGS. 2 and 4.

In addition, on one end (17) of the rail body (1), a joint member (14) is also provided separately from the rail body (1) for connecting a pipe (not illustrated) from a high-pressure pump. The joint member (14) has a cylindrical (tubular) shape, and a communication passage (20) is provided inside of the joint member (14). In addition, an annular projection (15) is projected in the circumferential direction from an outer periphery of the center part of the length direction of the joint member (14). In addition, the outer diameter of a base end (16) side of the joint member (14) is specified to be slightly smaller than the inner diameter of the one end (17) side of the rail body (1). Thus, the base end (16) of the joint member (14) is inserted in and arranged on the inner periphery of the one end (17) of the rail body (1) until the annular projection (15) is in contact with an opening end surface (18) of the rail body (1) and then fixed by brazing.

As described above, since the joint members (6), (14) are manufactured separately from the rail body (1), it is possible to use the high strength material only for the joint members (6), (14). Thus, the strength can be kept high especially for the joint portion in the entire rail. Accordingly, the present invention is capable of bearing an increment of pressure of the fuel. Since it is not necessary to use expensive high strength material for the entire rail, the cost can be kept low.

In addition, since the joint member (6) manufactured separately from the rail body (1) can be arbitrarily connected to a desired position of the rail body (1), flexibility of the attachment interval and attachment angle of the joint member (6) attached to the rail body (1) is increased. Thus, flexibility of layout can be improved. Furthermore, in the conventional forged rail in which the joint portion is integrally manufactured with the rail body, a large cutting machine is required when thread cutting or the like is performed on the joint portion. However, when the joint members (6), (14) are manufactured separately as shown in the present invention, the thread cutting can be performed only for the joint members (6), (14) and then the joint members (6), (14) can be assembled with the rail body (1). Thus, the large cutting machine is not required for processing the joint members (6), (14). Consequently, the processing work can be facilitated.

Second Embodiment

Figure 5:
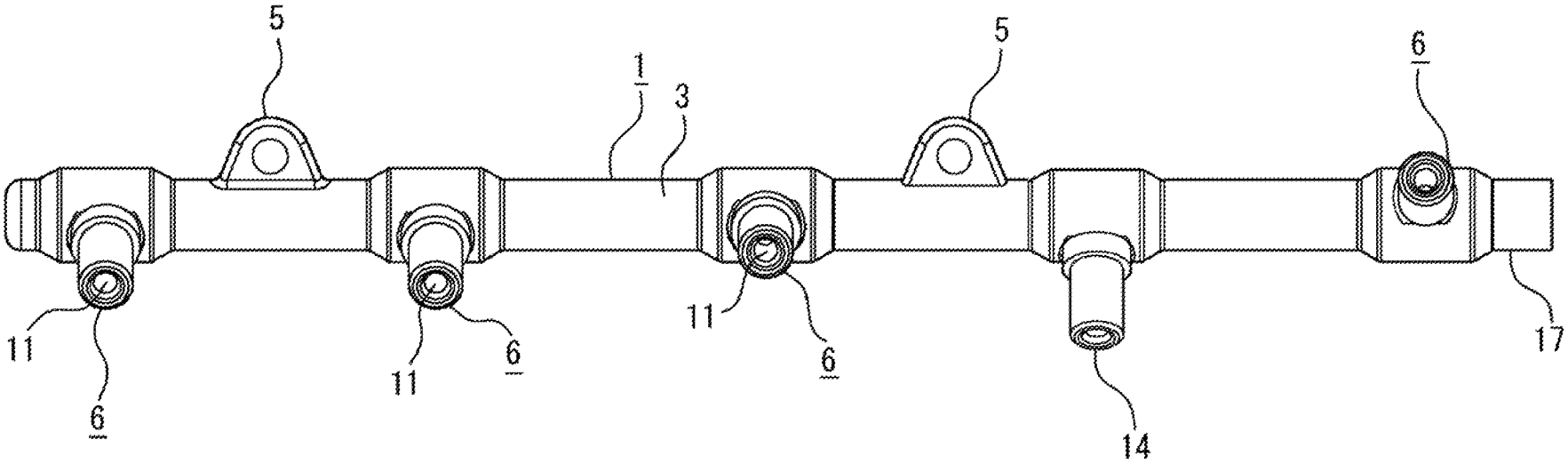
FIG. 5 is a perspective view of the second embodiment

Although the joint member (14) for connecting the high-pressure pump is provided on one end of the rail body (1) in the axial direction of the rail body (1) in the first embodiment, the joint member (14) for connecting the high-pressure pump is provided in a perpendicular direction of the rail body (1) in the present embodiment as shown in FIG. 5. The other joint members (6), which are provided in a perpendicular direction of the rail body (1), are provided at three parts in the present embodiment, while the joint members (6) are provided at four parts in the first embodiment. Except for the above described point and the joint member (14), the configuration of the present embodiment are same as the configurations of the first embodiment.

DESCRIPTION OF THE REFERENCE NUMERALS

1 rail body

2 fuel passage

3 wall surface

4 through hole

6, 14 joint member

17 one end

The invention claimed is:

1. A rail for high-pressure direct injection, comprising:

a rail body manufactured by forging, the rail body having a through hole opened on a wall surface of the rail body for communicating a fuel passage extending in an axial direction of the rail body with an outside; and a first tubular joint member manufactured separately from the rail body and fixed to the rail body at a position of the through hole for allowing a fuel to flow from the fuel passage through the through hole, wherein an engaging recess having a circular plane shape is provided on a periphery of the through hole of the rail body, a base end portion of the tubular joint member has a cylindrical shape having a smaller outer diameter than other portions of the first tubular joint member, the engaging recess has a larger outer diameter than the through hole and a smaller outer diameter than the other portions of the first tubular joint member, the base end portion of the first tubular joint member is directly inserted and arranged in the engaging recess formed on an outer periphery of the rail body without interposing other members between the first tubular joint member and the rail body, and the tubular joint member abuts against different surfaces of the outer periphery of the rail body, the different surfaces are parallel to the axial direction of the rail body and located at different diameters of the rail body.

2. The rail for high-pressure direct injection according to claim 1, wherein a second tubular joint member manufactured separately from the rail body is arranged and fixed on one end of the rail body for allowing the fuel to flow from the fuel passage through the one end of the rail body.

3. The rail for high-pressure direct injection according to claim 1, wherein a mechanical strength of the first tubular joint member is higher than the mechanical strength of a member jointed to the first tubular joint member.

4. The rail for high-pressure direct injection according to claim 2, wherein a mechanical strength of the first and second tubular joint members is higher than the mechanical strength of a member jointed to the first and second tubular joint members.

5. The rail for high-pressure direct injection according to claim 1, wherein a diameter of the first tubular joint member is reduced at the base end portion.

6. The rail for high-pressure direct injection according to claim 1, wherein a connecting recess having a larger diameter than an outer diameter of the first tubular joint member is formed on an outer periphery of the through hole, and the through hole is located at the center of the connecting recess.

7. The rail for high-pressure direct injection according to claim 1, wherein an outer diameter of the rail body is larger at a portion on which the engaging recess is formed than other portions on which the engaging recess is not formed.

8. The rail for high-pressure direct injection according to claim 1, wherein the engaging recess has a smaller outer diameter than a contact portion of the first tubular joint member, the contact portion being in contact with an outer periphery of the rail body.

* * * * *